US009995520B2

(12) United States Patent
Toma

(10) Patent No.: US 9,995,520 B2
(45) Date of Patent: Jun. 12, 2018

(54) AUTOMATIC TURNING ICE BLOCK APPARATUS AND METHOD

(71) Applicant: Hani Toma, El Cajon, CA (US)

(72) Inventor: Hani Toma, El Cajon, CA (US)

( * ) Notice: Subject to any disclaimer, the term of this patent is extended or adjusted under 35 U.S.C. 154(b) by 29 days.

(21) Appl. No.: 15/204,118

(22) Filed: Jul. 7, 2016

(65) Prior Publication Data

US 2016/0313043 A1 Oct. 27, 2016

Related U.S. Application Data

(63) Continuation of application No. 14/864,699, filed on Sep. 24, 2015, now Pat. No. 9,482,456.

(60) Provisional application No. 62/054,426, filed on Sep. 24, 2014.

(51) Int. Cl.

| | |
|---|---|
| ***F25C 1/04*** | (2006.01) |
| ***F25C 1/22*** | (2006.01) |
| ***F25C 5/04*** | (2006.01) |
| ***B29C 33/04*** | (2006.01) |
| ***F25C 1/12*** | (2006.01) |

(52) U.S. Cl.

CPC ..... *F25C 1/12* (2013.01); *F25C 1/04* (2013.01); *F25C 1/22* (2013.01); *F25C 5/04* (2013.01); *F25C 2305/022* (2013.01); *F25C 2600/02* (2013.01)

(58) Field of Classification Search

CPC ..... F25C 1/10; F25C 3/00; F25C 1/04; F25C 1/22; F25C 1/225; F25C 1/24; F25C 1/243; F25C 1/246; F25D 17/02; B29C 33/04; B22D 7/005

USPC ..... 249/79

See application file for complete search history.

(56) References Cited

U.S. PATENT DOCUMENTS

| | | | | | |
|---|---|---|---|---|---|
| 1,882,189 | A | * | 10/1932 | Miller | F25C 1/06 62/185 |
| 1,924,988 | A | * | 8/1933 | Grayson | F25C 1/10 452/74 |
| 2,649,764 | A | * | 8/1953 | Kosmas | A23G 9/083 134/105 |
| 2,766,596 | A | * | 10/1956 | Baker | F25C 1/04 137/616 |
| 3,483,712 | A | * | 12/1969 | Gram | A23G 9/10 62/356 |

* cited by examiner

*Primary Examiner* — Grant Moubry
*Assistant Examiner* — Erik Mendoza-Wilkenfel
(74) *Attorney, Agent, or Firm* — Reem Allos

(57) ABSTRACT

An evaporator apparatus comprising at least one container configured to maintain liquid for freezing and a plurality of heat transfer compartments configured around the at least one container to allow for the flow of cold anti-freeze in order to freeze the liquid and warm anti-freeze in order to thaw frozen blocks of ice contained within the evaporator apparatus. A lever integrated into the body of the evaporator to allow for rotation of the evaporation in order to harvest the frozen blocks of ice. The evaporator further including, at least one inlet opening to allow for the inflow of anti-freeze into the plurality of heat transfer compartments and at least one outlet opening to allow for the discharge of anti-freeze from the evaporator apparatus.

20 Claims, 12 Drawing Sheets

300 LB 134
133
110

135
109
108
106

171
108
134

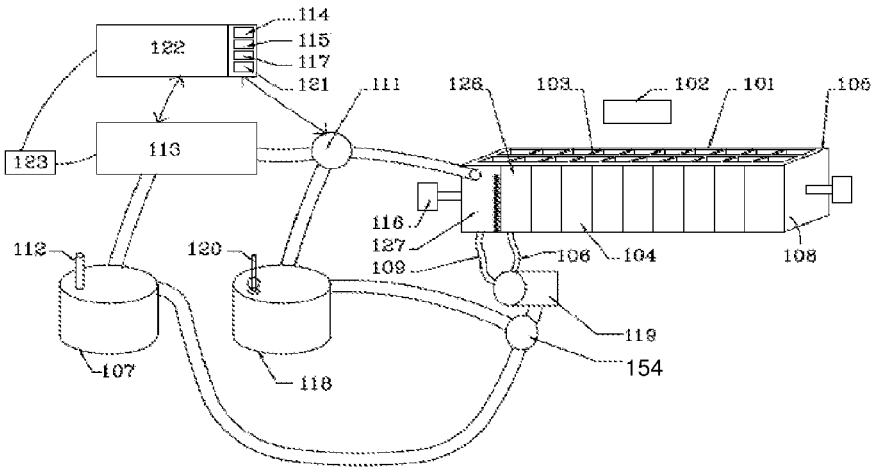
FIG. 11
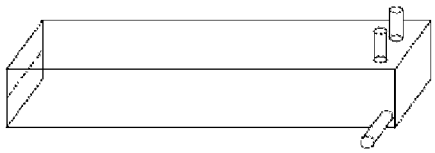

AUTOMATIC TURNING ICE BLOCK APPARATUS AND METHOD

CROSS-REFERENCE TO RELATED APPLICATIONS

The present application claims the benefit of: U.S. Provisional Patent Application Ser. No. 62/054,426 filed Sep. 24, 2014 and entitled "AUTOMATIC TURNING ICE BLOCK APPARATUS AND METHOD" and U.S. Utility patent application Ser. No. 14/864,699 and entitled "AUTOMATIC TURNING ICE BLOCK APPARATUS AND METHOD" hereby expressly incorporated by reference in its entirety. Furthermore, any and all priority claims identified in the Application Data Sheet, or any correction thereto, are hereby incorporated by reference under 37 C.F.R. § 1.57.

FIELD OF THE INVENTION

This invention relates generally to the field of ice making equipment or other similar machines for creating frozen blocks from liquid, and more particularly relates to such machines which produce a relatively large block from liquid. The invention further relates to the mechanism for releasing frozen blocks of ice by use of a turning means.

BACKGROUND

This disclosure relates to an ice machine which makes and harvests blocks of ice automatically. Existing machines for making blocks of ice are unduly complex, corrode over time, and produce ice which may not be sanitary, are not energy/cost effective and/or require the presence of personnel to operate the machine. These factors lead to increased costs of production of ice blocks. The ice machine of the present invention overcomes the aforementioned disadvantages.

SUMMARY

The present invention is directed at an ice machine which is energy cost effective and does not require the attendance of an operator while making and harvesting blocks of ice. The machine is totally automatic and can operate twenty-four hours a day without the presence of an operator.

In one aspect of the invention, an apparatus for freezing a liquid into a plurality of large solid blocks and subsequently automatically releasing the large solid blocks by enabling an external controller/gearbox configured to rotate the body of the apparatus in order to release the plurality of ice blocks without manual handling or touching. Around the perimeter of the evaporator are a number of rectangular shaped heat transfer compartments configured horizontally along the bottom of the evaporator and vertically around the four sides of the rectangular evaporator and optionally around each of the containers configured to hold liquid, where a refrigerant composition, typically a refrigerant liquid of known type such as ammonia, Freon, or anti-freeze, is directed through an opening to freeze a liquid (typically, water into ice). After a configured number of hours when desired interior temperature is reached the cold anti freeze (or refrigerant) will stop cycling around the evaporator and exit the evaporator. Also, the evaporator comprising a turning means to allow an external controller/gearbox or external system to facilitate 180 degree rotation in order to release the plurality of ice blocks from their respective containers after the cold anti-freeze exits the evaporator. Further, where a defrosting fluid (or anti-freeze) of room or elevated temperature, typically a liquid or gas, is subsequently directed through the inlet then into the heat transfer compartments surrounding the perimeter (i.e. 4 sides) and bottom portion of the body of the evaporator to enable the plurality of ice blocks to separate and release from the container by creating a thin layer of melted material adjacent the heat transfer compartments.

In another aspect of the disclosure, an ice block apparatus including at least one inner casing configured to receive liquid, including an open top side configured to allow the receipt of water, wherein the at least one inner casing may comprise an inner structure having a bottom side and four vertical sides. The ice block apparatus further including an outer casing configured along exteriors of the at least one inner casing creating a chamber configured between the inner casing and the outer casing, wherein the outer casing may allow for the chamber to exist within the space between the exterior of the inner casing and the interior of the outer casing. The chamber may be hollow. The ice block apparatus further including an inlet means configured to allow anti-freeze into the chamber, the inlet means may be an opening within a bottom portion of the ice block apparatus. The ice block apparatus further including an outlet means configured to allow for the discharge of antifreeze from the chamber, the outlet means may be an opening within a top portion of the ice block apparatus. The ice block apparatus further including a supporting framework attached to the outer casing configured to allow the turning of the ice block apparatus.

In yet another aspect of the disclosure, a method of freezing ice blocks including pouring a liquid into a liquid reservoir maintained within an ice block apparatus in an upright position. The method of freezing ice blocks including allowing a cold antifreeze from a cold antifreeze reservoir through an entrance valve to an inlet means by means of a pump into an inner chamber of the ice block apparatus. The method of freezing ice blocks further including allowing the cold antifreeze within the inner chamber of the ice block apparatus to be discharged through a discharge means to a dump valve directed towards a refrigeration system to be cooled and returned to the cold antifreeze reservoir. The cold antifreeze reservoir may contain a thermostat used in conjunction with a control timer to allow the controller to determine that the liquid within the liquid reservoir is frozen. The method of freezing ice blocks further includes allowing the cold antifreeze to circulate through the inner chamber of the ice block apparatus, the refrigeration system, and the cold antifreeze reservoir until a controller determines that the liquid within the liquid reservoir is frozen. The method of freezing ice blocks further includes turning the ice block apparatus in the upright position by one hundred and eighty degrees by means of an external apparatus. The method of freezing ice blocks further includes allowing warm anti-freeze from a warm antifreeze reservoir through the entrance valve to the inlet means by means of a pump into the inner chamber of the ice block apparatus. The method of freezing ice blocks further includes allowing the warm antifreeze within the inner chamber of the ice block apparatus to be discharged through the discharge means to a dump valve directed towards the warm antifreeze reservoir. The warm antifreeze reservoir may utilize a float switch to determine when to discontinue the flow of warm antifreeze through the entrance valve into the inner chamber of the ice block apparatus. The method of freezing ice block further includes harvesting the frozen liquid within the liquid reservoir and waiting until the remaining warm antifreeze is discharged from the inner chamber of the ice block apparatus. The method of freezing ice block further includes returning the ice block apparatus into the upright position by means of the external apparatus, wherein the external apparatus may be a gear and motor apparatus configured to turn the ice block apparatus into a harvest position and an upright position. The method of freezing ice blocks, further including utilizing a discharge timer to determine when the warm antifreeze has been discharged from the ice block apparatus. Also, the entrance valve and/or the dump valve may be a three way valve.

In yet another aspect of the invention, a ten pound ice block apparatus, including a plurality of reservoirs configured to receive liquid for freezing and a first cavity encasing the exteriors of the plurality of reservoirs, having a hollow inner cavity encompassing the volume of space between the exterior of the plurality of reservoirs and the interior of the first cavity. The ten pound ice block apparatus further includes a second cavity used to receive overflow antifreeze exiting from the inner cavity by means of a first outlet means. Also, the ten pound ice block apparatus further includes an inlet means configured to allow antifreeze to enter the inner cavity, a second outlet means configured to allow antifreeze to exit the discharge compartment and re-circulate back into the inner cavity, and an overflow means configured to allow antifreeze to exit the discharge compartment and returned to an antifreeze reservoir. Lastly, the ice block apparatus further includes a turning means configured to allow an external apparatus to rotate the ten pound block apparatus upside down and right side up. The plurality of reservoirs may be rectangular in shape. The discharge compartment may be adjacent to the first cavity. The inlet means may be an opening within a bottom portion of the first cavity. The second outlet mean may be an opening within a bottom portion of the second cavity. The overflow means may be an opening within the top portion of the second cavity. The first out let means may be an opening between the first cavity and the second cavity.

BRIEF DESCRIPTION OF THE DRAWINGS

FIG. 11 illustrates a refrigeration system for the 10 lbs. block evaporator.

DETAILED DESCRIPTION

Figure 1:
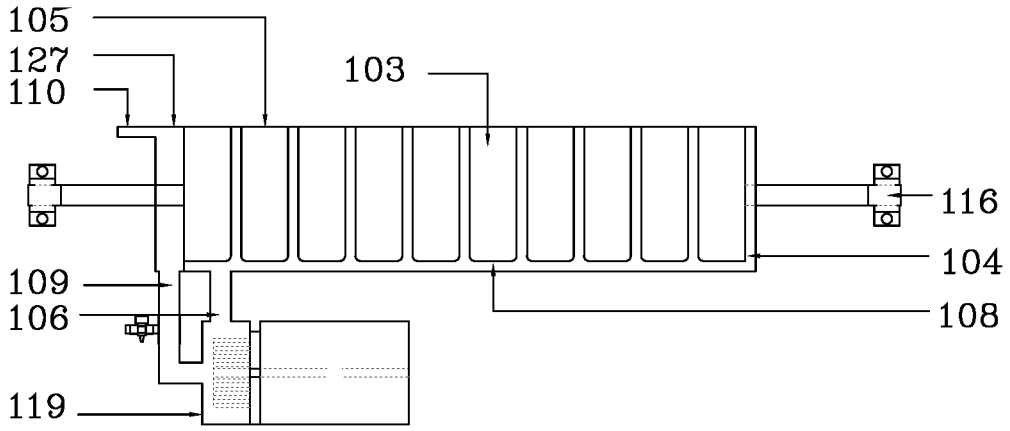
FIG. 1 illustrates a side view of an ice block evaporator for 10 lbs. block.

FIG. 1 is an exemplary embodiment of a side view of an ice block evaporator for 10 lbs. block. In one embodiment, a rectangular shaped 10 lb evaporator 105 having four sides and bottom section and plurality of containers for which liquid (i.e. water) are to be housed for the formation of ice blocks. The top portion of the 10 lb evaporator 105 is open and does not contain a cover or heat transfer compartment, but rather open to allow for the entrance of water or other liquids into containers 103 housed within the evaporator. The evaporator may comprise at least one lever 116 extending a horizontally from one end of the evaporator to the other end. In one embodiment, two levers 116, one on each side of the evaporator as shown in FIG. 1. Each lever 116 within the evaporator will comprise a turning means to allow the 180 degree turn of the evaporator after the liquid contained within the containers is ready for harvesting due to reaching ideal temperatures or being frozen. At the bottom portion of the evaporator 105 is a first heat transfer compartment 108 which allow for the flow of anti-freeze to travel from the first inlet (anti-freeze in 106) 106 and upwards through each of the four vertical heat exchange compartments the to the overflow outlet opening 133. In addition, around each of the four vertical sides of the 10 lb evaporator 105 is a heat transfer compartment (the volume of space in between the external of the container 103 walls and interior of the evaporator OR the volume of space in between the external of the container 103 walls of two or more containers) which allow for the flow of refrigerant or anti-freeze within. The cold anti-freeze enters the evaporator from the first inlet 106 which may have an entrance control valve (not shown) to control the inlet flow of cold anti-freeze into the evaporator. From the first inlet 106, the cold anti-freeze then travels towards the water pump 119 where the motor of the water pump 119 forces the refrigerant or anti-freeze to travel towards the lower heat transfer component 108 along the bottom portion of the 10 lb evaporator 105. As the cold anti-freeze begins to accumulate within the lower heat transfer compartment 108, the anti-freeze will pass through a small opening 171 wherein the anti freeze will rise through each of the vertical heat transfer components 134 between the containers and alongside the inside perimeter of the 10 lb evaporator 105, or optionally configured internally within the exterior of said containers housed within the 10 lb evaporator 105. When the anti-freeze reaches the top portion of the 10 lb evaporator 105, then it will exit from the discharge outlet opening 110 and travel through the dump valve 111 (not shown) towards the water pump 119 to be cycled through the evaporator. Once the evaporator has reached a desired temperature for a desired period of time to allow for liquid within the containers to freeze then the evaporator will request the cold anti-freeze to exit by means of the discharge outlet opening 110 wherein the anti-freeze 104 will cycle through the external refrigeration system comprised of a compressor (not shown), condenser (not shown) and expansion valve (not shown). After the 10 lb evaporator 105 is turned 180 degree by an external sub-system (not shown) then the external refrigeration system will begin to provided room temperature or warm anti-freeze into the evaporator by means of the first inlet 106 to allow for the harvesting of frozen blocks within the containers (not shown). The warm anti-freeze 125 will be pumped into the lower heat transfer compartment 108 along the bottom (now top) portion of the 10 lb evaporator 105 wherein the warm anti-freeze 125 will propagate towards the vertical heat transfer components 134 in between the containers and along the perimeter of the 10 lb evaporator 105 and exiting by means of overflow outlet opening 133 into the overflow cavity 135, then flowing downward towards the re-circulate outlet line 109 and cycled through to the water pump 119 again into the evaporator. Once the overflow cavity 135 is filled, then the anti-freeze is discharged through the overflow outlet opening 110. As the release (or harvesting cycle) continues, the walls of the containers will begin to melt and allow for the release of ice blocks from the evaporator.

Figure 2:
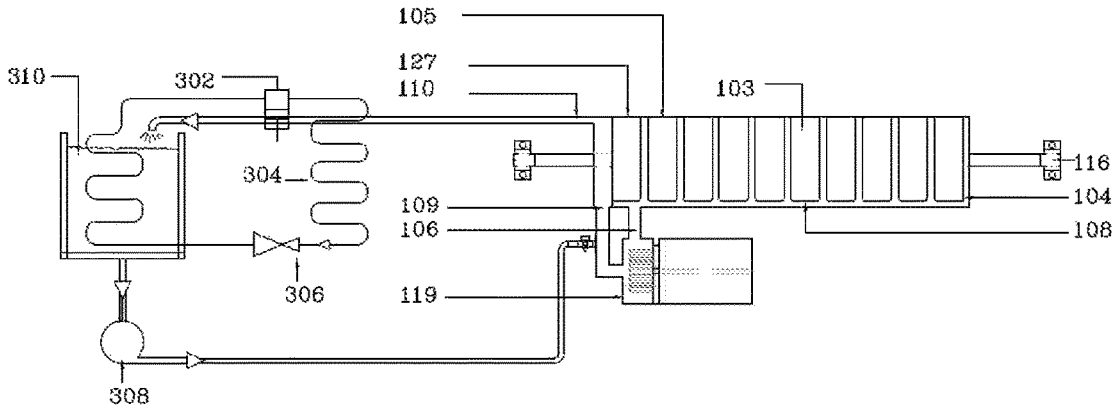
FIG. 2 illustrates a side view of the ice block system for 10 lbs. block.

FIG. 2 illustrates a side view of the ice block system for 10 lbs. block. FIG. 2 illustrates the evaporator shown and described in FIG. 1 above with a focus onto describing the external system configured to provide the cold and warm temperature anti-freeze into the evaporator. In one embodiment, the discharge outlet opening 110 provides anti-freeze into the external system from the 10 lb evaporator 105 whereby the external system is responsible for modifying the chemical properties of the anti-freeze to suit the needs desired by the evaporator at that particular time. In another embodiment, the discharge outlet opening 110 provides cold anti-freeze into the external system from the evaporator whereby the external system comprising compressor 302, condenser 304, and expansion valve 306 to modify the cold anti freeze into warn anti-freeze and direct the warm anti-freeze into the first inlet 106 to be processed by the evaporator. In yet another embodiment, the discharge outlet opening 110 provides warm anti-freeze into the external system from the evaporator whereby the external system comprising compressor 302, condenser 304, and expansion valve 306 modify the cold anti-freeze into warn anti-freeze and direct the warm anti-freeze into the first inlet 106 to be processed by the 10 lb evaporator 105.

Figure 3:
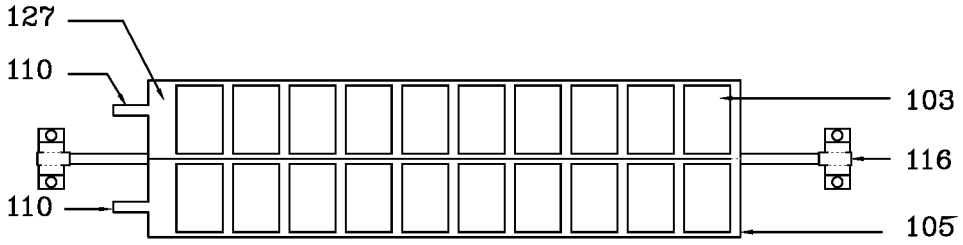
FIG. 3 illustrates a top view of the ice block evaporator for 10 lbs block.

FIG. 3 illustrates a top view of the ice block evaporator for 10 lbs block. FIG. 3 provides a top view prospective of the 10 lb evaporator 105 wherein pluralities of containers are housed within the evaporator 105 (i.e. 20 containers). In addition, the 10 lb evaporator 105 may include internally at least four heat transfer components along the A, B, C, D sides of the 10 lb evaporator 105. In another embodiment of FIG. 2, the evaporator may include internally a plurality of heat transfer chambers between the space between the exterior walls of the containers and the interior wall of the 10 lb evaporator 105. Additionally, FIG. 3 provides an example of a 10 lb evaporator 105 comprising at least two discharge outlet openings 110. Moreover, FIG. 3 provides an example of containers 103 which may be filled with liquid and allowed to freeze. Also, FIG. 3 provides an example of the lever 116 extending between two sides of the 10 lb evaporator 105 with a beam configured internally within the evaporator 105 to allow for the turning of the evaporator by an external system (not shown). The 10 lb evaporator 105 contains a side cavity 127 to allow the overflow of anti-freeze from the plurality of heat transfer chambers to be deposited, and when the side cavity is filled to capacity, and then the side cavity 127 integrates with the discharge outlet opening 110 to allow the anti-freeze to exit the 10 lb evaporator 105.

Figure 4:
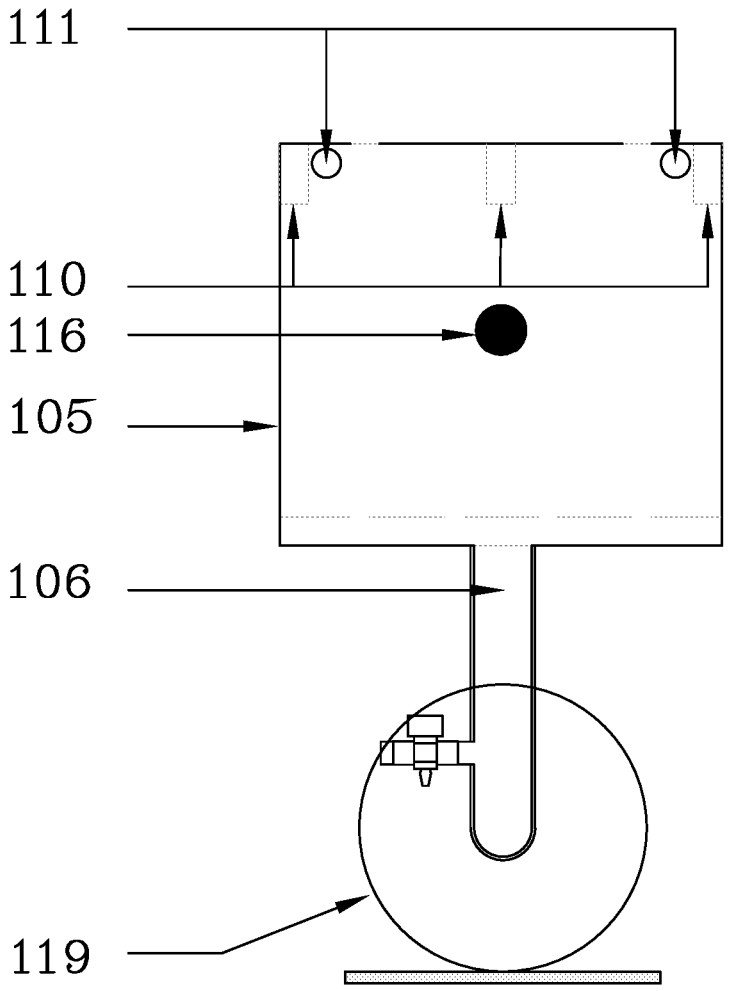
FIG. 4 illustrates a side view of an ice block evaporator for 10 bs block.

FIG. 4 illustrates a side view of an ice block evaporator for 10 bs block. In one embodiment, the first inlet 106 allows anti-freeze to be directed if the entrance control valve (not shown) is opened to release anti-freeze towards the water pump. The water pump 119 pumps anti-freeze upward into the 10 lb evaporator 105 and first heat transfer compartment 108 along the bottom portion of the evaporator. In an exemplary embodiment, the evaporator may contain two dump valves 111 to allow for the release of anti-freeze either back to the water pump 119 or towards the external system (shown and described in FIG. 2). On embodiment, the evaporator may contain one or more discharge outlet opening 110, to allow for circulation or the release of pressure within the evaporator. Lastly, as shown in FIG. 4 the side view illustrates the presence of a lever 116 to allow for turning of the ice block up to 180 degrees.

Figure 5:
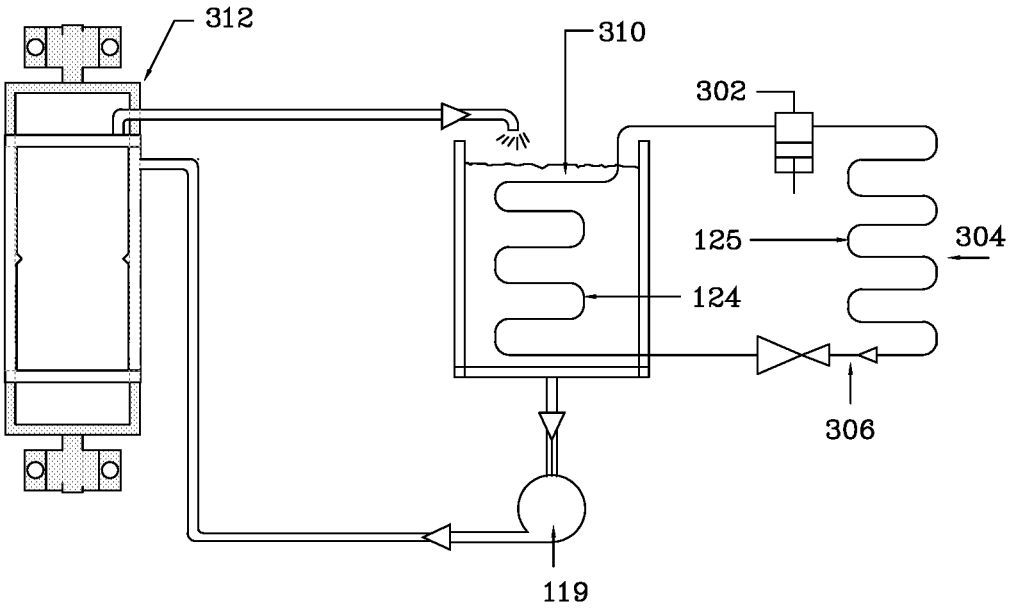
FIG. 5 illustrates the top view of the ice block system for 300 lbs. block.

FIG. 5 illustrates the top view of the ice block system for 300 lbs. block. A complete refrigeration system may be comprised of the following set of components, including an evaporator 312, compressor 302, condenser 304, expansion valve 306, and pump 119. In one embodiment, the integration of these components begins with the compressor 302 receiving vaporized anti-freeze by means of an anti-freeze return wherein the compressor pushes vaporized anti-freeze to the condenser 304 wherein the condenser 304 transforms the chemical makeup of the anti-freeze from a vapor to liquid state. The liquid refrigerant will be held in a cold anti-freeze tank during this process. The liquid anti-freeze 124 then goes through an expansion valve 306 where it is pressurized and forced by means of a pump 119 to enter the evaporator 312 to cool the contents of the evaporator 312.

Dependent upon a preconfigured setting, the anti-freeze exits the evaporator it returns to the compressor 302 for processing once more. Upon reaching a desired temperature for a pre-determined timeframe the automatic turning ice block apparatus will begin to release the cold-anti-freeze 124 back to the compressor 302. Upon semi or complete exit of the cold anti-freeze from the evaporator 312 the evaporator 312 will begin to turn up to 180 degrees by means of an external gearbox/controller or external system configured to rotate the evaporator 312. Thereafter, a secondary tank (not shown) containing warm anti-freeze 125 will be pumped by the pump 119 in order to dispense warm anti-freeze 125 into the evaporator 312 to allow for the container 103 inside the evaporator containing frozen ice block to begin to thaw alongside the interior walls and permit the release of ice block from the containers 103 as a result thereof.

Figure 6:
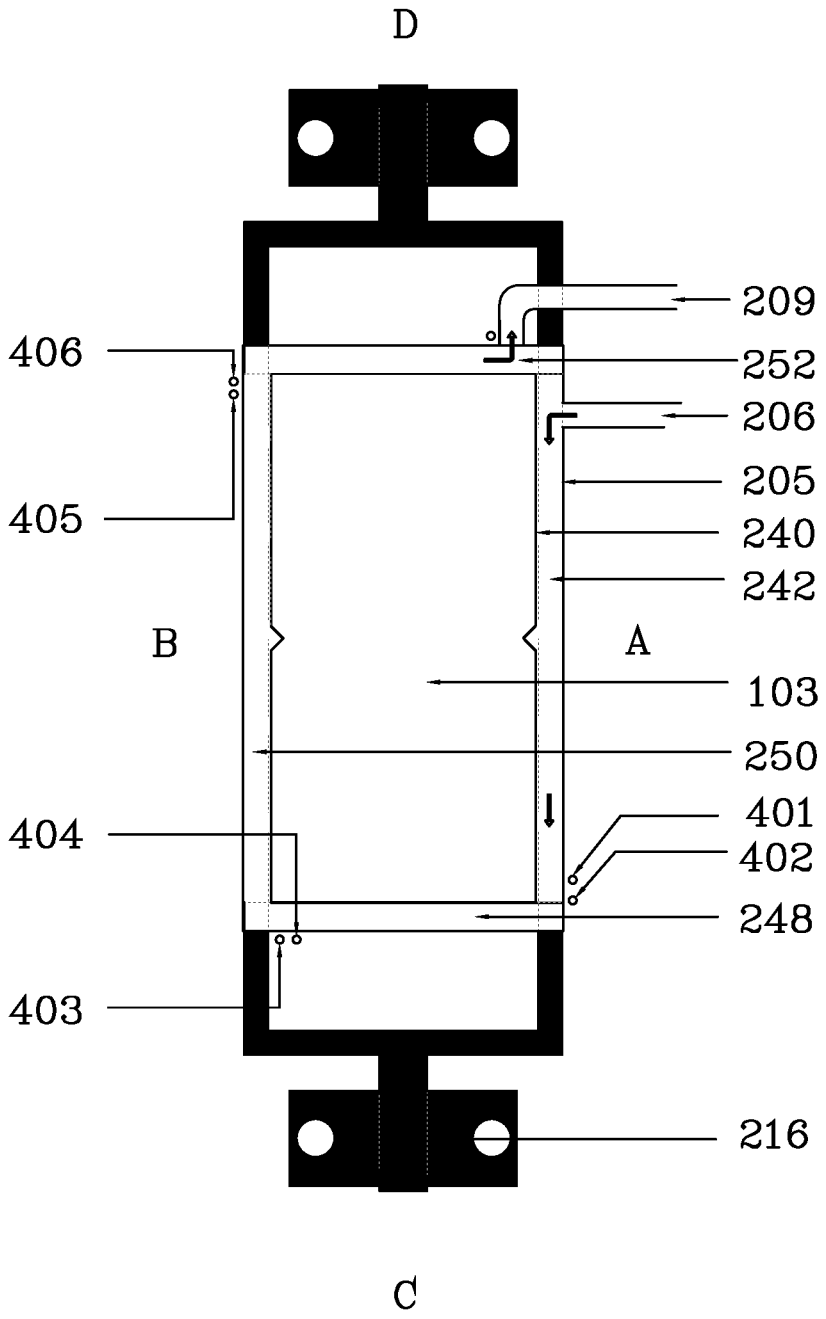
FIG. 6 illustrates the top view of the ice block evaporator for 300 lbs. block.

FIG. 6 illustrates the top view of the ice block evaporator for 300 lbs. block. An exemplary 300 lbs. ice block evaporator contains a plurality of components which will be described in detail below. In one embodiment, the process of cooling liquid within the single container 103 having exterior container walls 240 includes the first inlet 206 permitting the flow of cold anti-freeze 124 to enter the top portion of the 300 lb evaporator 205. The cold anti-freeze 124 then fills the first heat transfer compartment 242 extending the entire right most side (Side A) of FIG. 6. Each of heat transfer compartments comprises a space between the 300 lb evaporator 205 and the container walls 240. When the anti-freeze 124 has completely filled the heat transfer compartment 240 (Side A) it will begin to exit through an opening in the bottom 401 of Side A and entering through the opening in the bottom of 402 of Side C where the integration of these two openings is diagonal pathway from Side A to Side C. The cold anti-freeze 124 then fills the second heat transfer compartment 248 extending the entire of Side C of FIG. 6. When the anti-freeze has completely filled the heat transfer compartment 248 (Side C) it will begin to exit through an opening in the top 404 of Side C and entering through the opening in the top of 403 of Side B where the integration of these two opening is diagonal pathway from Side C to Side B. The cold anti-freeze 124 then fills the third heat transfer compartment 250 extending the entire of Side B of FIG. 6. When the anti-freeze 124 has completely filled the heat transfer compartment 250 (Side B) it will begin to exit through an opening in the bottom 405 of Side B and entering through the opening in the bottom of 406 of Side D where the integration of these two opening is diagonal pathway from Side B to Side D. The cold anti-freeze 124 then fills the fourth heat transfer compartment 252 extending the entire of Side D of FIG. 6. When the anti-freeze has completely filled the heat transfer compartment 252 (Side D) it will begin to exit through an opening in the exit line 209 of Side D. The exit line 209 will transmit the anti-freeze to the external system shown and described in FIG. 5 above.

In one embodiment of FIG. 6 of the 300 lbs. ice block evaporator, the evaporator may be comprised of an external 300 lb evaporator 205 encompassing the multiple heat transfer compartments (242, 248, 250, and 252) and configured with a rod threaded through the inside central portion of the 300 lb evaporator 205 whereby to permit the turning of the evaporator by means of turning means integrated with the lever 216 as shown and described in FIG. 6. Moreover, the 300 lb evaporator 205 may need additional support in order to turn the block of ice within the evaporator after it's been frozen and ready for harvesting. Therefore, there is a need for the 300 lb evaporator 205 to have a proper support by means of multiple solid stainless steel 1 inch by 2 inch square beams (not shown) extending from Side A to Side B and/or from Side C to Side D. Alternatively, the support beams (not shown) may be placed around the 300 lb evaporator 205 to support the evaporator 205 when the evaporator is rotated by an external system configured to rotate the evaporator up to 180 degrees.

After the cold anti-freeze 124 has been cycling throughout the 300 lb evaporator 205 for a predetermined time period (i.e. 5 hours) while desired internal temperature is reached, the cold anti-freeze 124 will receive an trigger or electronic signal to stop cycling around the evaporator and exit the evaporator by means of the exit line 209. Thereafter, the evaporator will begin to rotate up to 180 degree from its original position by means of external system acting on the turning means 216 to cause the rotation. After the evaporator is rotated 180 degrees then warm or room temperature anti-freeze 125 will begin to enter the evaporator by means of the inlet 206 and maintain the same flow as described above when the cold anti-freeze entered the except that the connecting pathways between sides will be in opposite configurations (i.e. if top then now it's at the bottom). As the warm anti-freeze makes its way through the four heat transfer compartments (242, 248, 250, and 252) the containers walls will be begin to release the attached ice and the warm anti-freeze 125[[*b*]] will exit from the exit line 209. After successful release of the ice from the evaporator, the external system acting on the turning means 216 will be triggered to rotate the evaporator back to its original position to begin the process once again.

Figure 7:
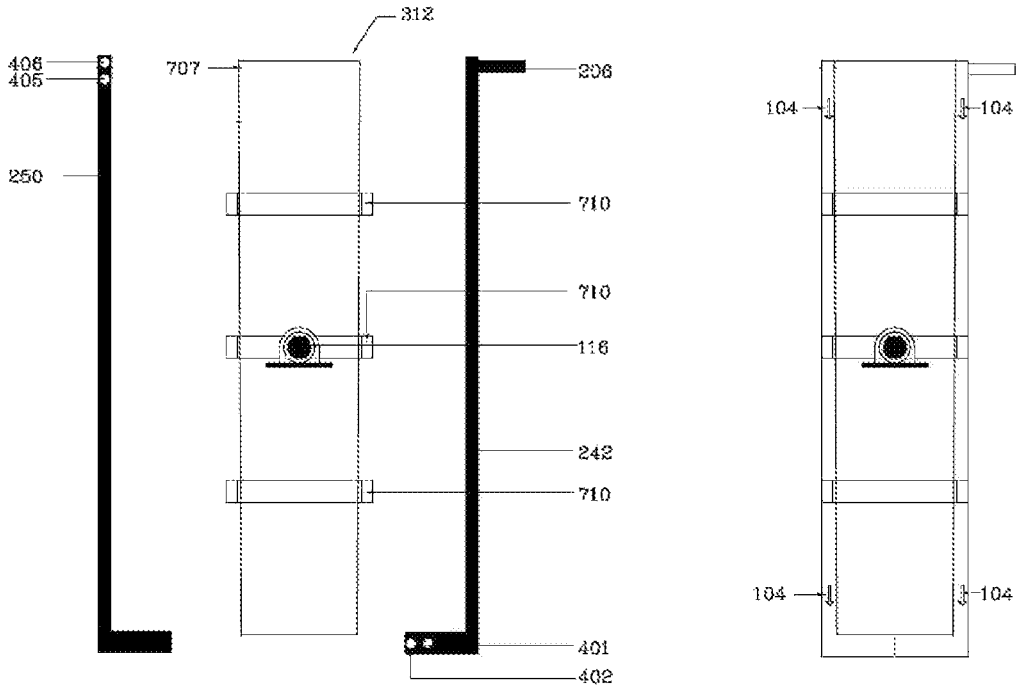
FIG. 7 illustrates the side view of the ice block evaporator for 300 lbs. block.

FIG. 7 illustrates the side view of the ice block evaporator for 300 lbs. block. In one embodiment, the inlet 206 permits the flow of cold anti-freeze 124 into the evaporator 312 whereby the cold anti-freeze 124 travels from the top most portion of heat transfer compartment 242 of Side A until it's filled. When the anti-freeze has completely filled the heat transfer compartment 242 (Side A) it will begin to exit through an opening in the bottom 401 of Side A and entering through the opening in the bottom of 402 of Side C where the integration of these two openings is diagonal pathway from Side A to Side C. In one embodiment, the container 707 within the evaporator 205 is supported by at least one support beam 710 or three support beams 710 (as shown in FIG. 7) surrounding the entire perimeter of the container. In one embodiment, the support beams comprising stainless steel beams measuring 1 inch by 2 inch and share shaped, other shapes and material may be used while still not diverging away from the purpose of these beams.

Figure 8B:
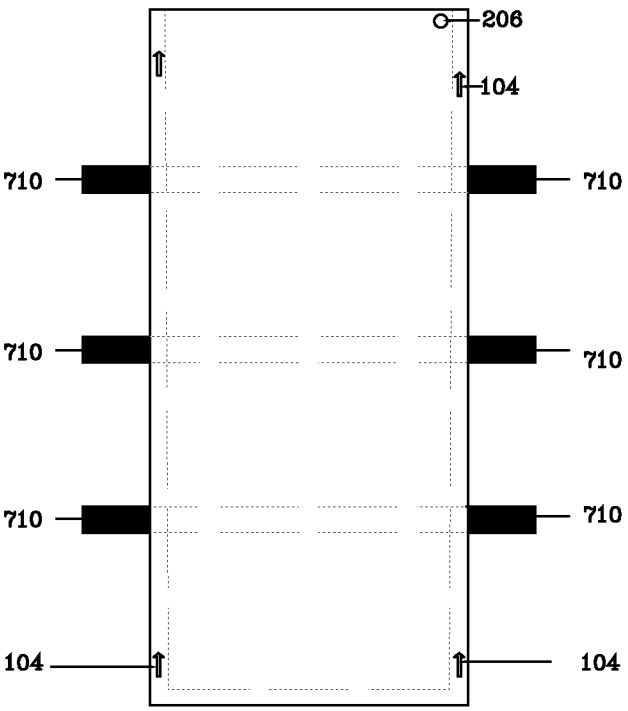
FIG. 8A and FIG. 8B illustrate the side views of the evaporator for 300 lbs. block.
Figure 8A:
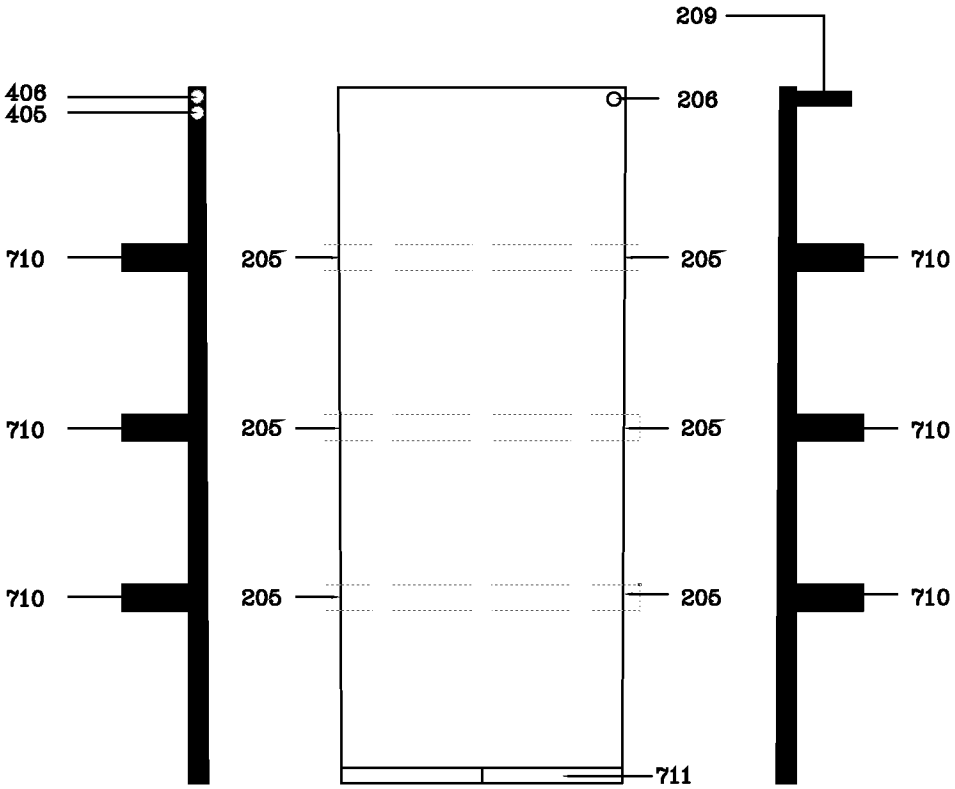

FIG. 8A illustrates the side view of the ice block evaporator for 300 lbs. block. In one embodiment, the inlet 206 permits the flow of cold anti-freeze 124 into the evaporator whereby the cold anti-freeze 124 travels from the top most portion of heat transfer compartment 242 of Side A until it's filled. In one embodiment, the container 103 within the 300 lb evaporator 205 is supported by at least one support beam 710 or three support beams as shown in FIG. 8B extending from Side A of the 300 lb evaporator 205 to Side B of the evaporator 205. In one embodiment, the support beams 710 comprising stainless steel beams measuring 1 inch by 2 inch and square shaped, other shapes and material may be used while still not diverging away from the purpose of these beams.

Figures 9A, 9B, 9C, 9D:
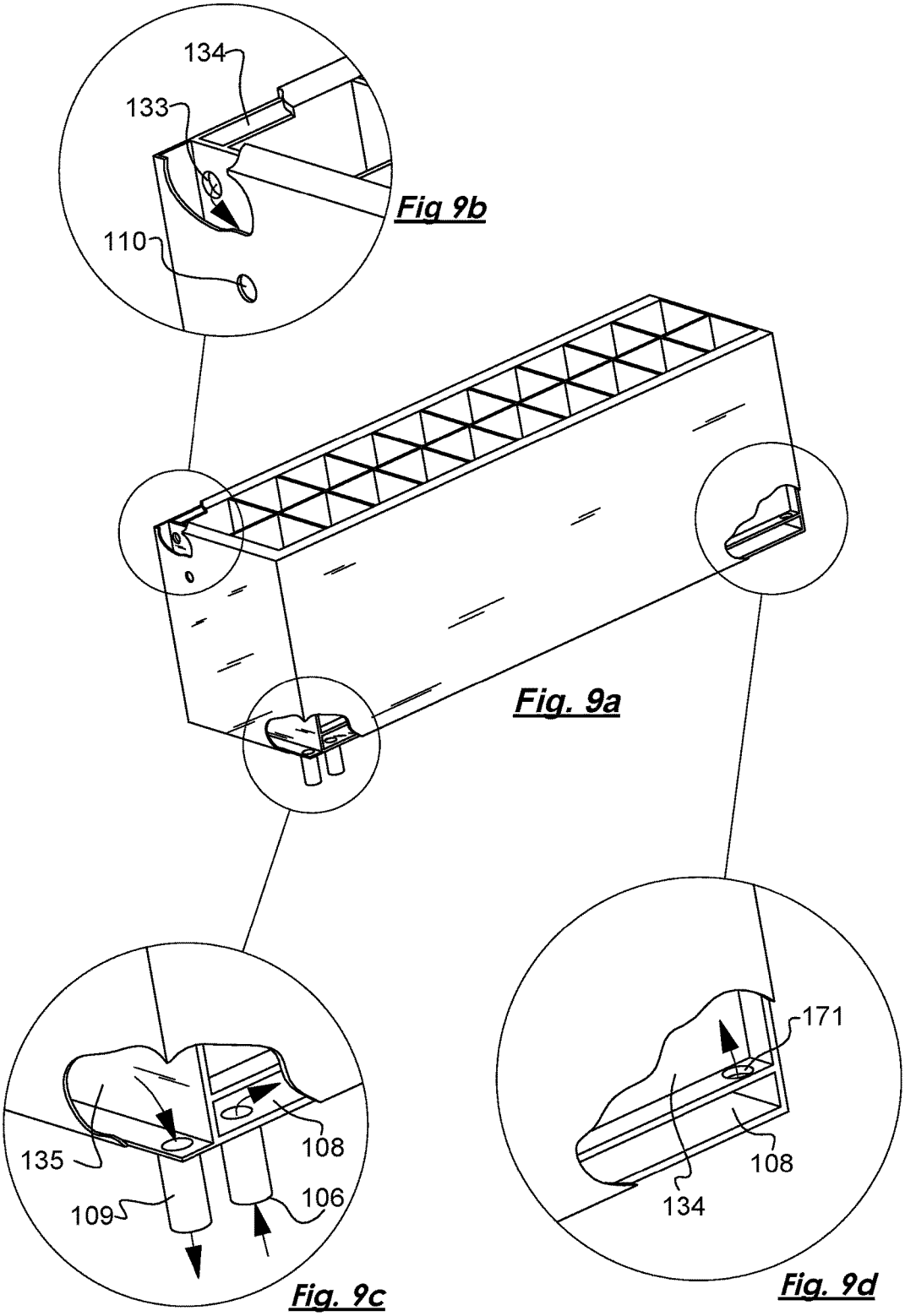
FIG. 9*a* illustrates a prospective view of the 10 lbs. ice block evaporator.
FIG. 9*b* illustrates an internal view of the overflow outlet opening of the 10 lbs. ice block evaporator.
FIG. 9*c* illustrates an internal view of the first inlet and re-circulate outlet of the 10 lbs. ice block evaporator.
FIG. 9*d* illustrates an internal view of the opening along the lower heat transfer compartment of the 10 lbs. ice block evaporator.

FIG. 9*a* illustrates a prospective view of a 10 lbs. ice block device. In one embodiment, the 10 lbs. ice block device is an evaporator apparatus configured to freeze liquid into solid state comprising a lower heat transfer compartment 108, and a plurality of vertical heat transfer compartments 134 configured between the interior lining of the 10 lb evaporator 105 and the exterior lining of each of the plurality of ice block containers 103 configured to store liquid for freezing. The apparatus includes a primary cavity where anti-freeze is dispensed for freezing purposes and a secondary cavity 127 to contain overflow anti-freeze and discharge anti-freeze from the evaporator. The apparatus is configured to receive anti-freeze through a lower opening, allow the anti-freeze to fill within the plurality of heat transfer compartments 108 and as the anti-freeze level rises within the evaporator then the ice contained within the plurality of containers begins to freeze more rapidly. The secondary cavity 127 is integrated with a re-circulate outlet line 109 to facilitate the recycling of anti-freeze into the evaporator and a discharge outlet opening 110 to facilitate the return of the anti-freeze to respective anti-freeze reservoirs. The 10 lbs device is comprised of a lever 116 along its center axis so as to allow the 10 lb device to rotate 360 degrees in order to allow for automatic harvest cycle. An external gear/motor will be configured to allow for the rotation of the 10 lbs. ice block apparatus.

FIGS. 9*a*, 9*b*, 9*c*, and 9*d* illustrate the internal prospective view of the 10 lb evaporator. In one embodiment, antifreeze flows through a first inlet 106 from a bottom portion of the apparatus into a lower heat transfer compartment 108 wherein the antifreeze fills the entire compartment 108 before proceeding upwards through a small opening 171. Upon filling the lower heat transfer compartment 108, the antifreeze will travel through the small opening 171 upwards into a plurality of heat transfer compartments 134 which surround the plurality of containers 103 housed within the evaporator 105. After the plurality of heat transfer compartments are filled with antifreeze, then the antifreeze will travel through an overflow outlet opening 133 into an overflow cavity 135. Thereafter, the anti-freeze will be discharged for re-circulation purposes through the re-circulate outlet line 109. After the overflow cavity 135 is filled with anti-freeze, then any overflow anti-freeze will be discharged through a discharge outlet opening 110 to be cooled in an external antifreeze reservoir (not shown).

Figure 10A:
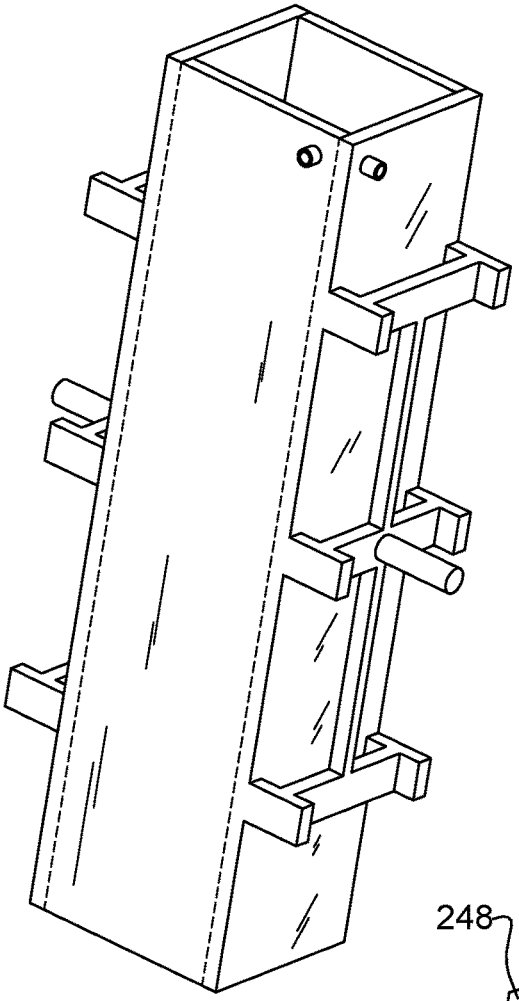
FIG. 10*a* illustrates a prospective view of the ice block evaporator for 300 lbs. block.

FIG. 10*a* is an illustrative a side views of a 300 lbs. ice block device. In one embodiment, the 300 lbs. ice block device is an evaporator apparatus configured to freeze liquid into solid state comprising at least one container configured to maintain liquid for freezing, a body configured to maintain the contents of the evaporator apparatus, and heat transfer compartment including the volume of space available between the exterior of the at least one container and the interior of the body of the evaporator. The 300 lbs. evaporator apparatus is comprised of a plurality of heat transfer compartments including: a inner cavity of the first side 242, a first half inner cavity of the second side 244, a second half of inner cavity of the second side 246, a inner cavity of the third side 248, an inner cavity of fourth side 250, and inner cavity of the fifth side 252. The 300 lbs. apparatus may have at least one opening to allow for the receipt of liquid for freezing into a center container. The 300 lbs. apparatus receives anti-freeze from a first inlet, which may be designed to reside on the top portion of the apparatus, but it may be anywhere within the apparatus, as well. The 300 lbs. apparatus discharges anti-freeze after the anti-freeze has cycles through the entire surface area of the evaporator, except the top, and the discharge opening may be configured along the top portion of the apparatus, but it may be anywhere within the apparatus, as well. The 300 lbs. apparatus contains support beams to facilitate the adequate rotation of the 300 lbs. apparatus in order to facilitate the harvest cycle. An exemplary flow of anti-freeze within the 300 lbs. apparatus is explained in FIG. 12.

Figure 10B:
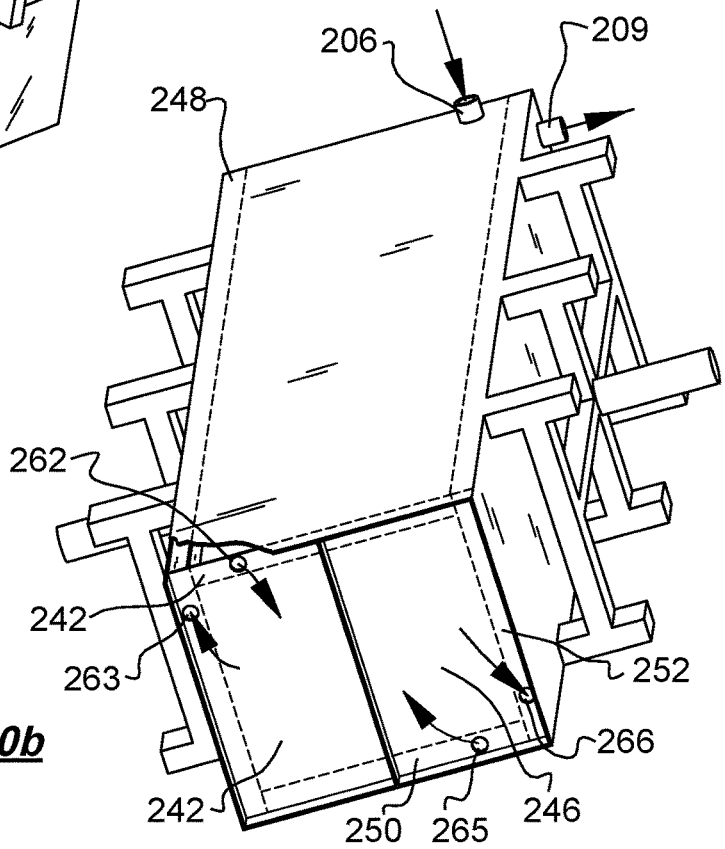
FIG. 10*b* illustrates a bottom and internal view of the ice block evaporator for 100 lbs. block.

FIG. 10*b* is an illustrative bottom and internal view of the 300 lb evaporator. In one embodiment, the 300 pound evaporator 205 receives cold antifreeze 124, through a first inlet 206 configured at the top of a first side 242 of the 300 pound evaporator 205. The cold antifreeze 124 begins to pass through the inner cavity of the first side 242 of the 300 pound evaporator 205 in a downward direction. As the cold antifreeze 124 reaches the bottom of inner cavity of the first side 242 it will begin to pass through a first small opening 262 connecting the bottom portion of the inner cavity of the first side 242, the first half of inner cavity of the second side 244, and a inner cavity of the third side 248 to allow the cold antifreeze to begin to pass through the inner cavity of the third side 248 of the 300 pound evaporator 205 in a upward direction through a second small opening 263. As the cold antifreeze 124 reaches the top portion of the inner cavity of third side 248 it will begin to pass through a third small opening 264 connecting the top of the inner cavity of the third side 248 and the top of a inner cavity of the fourth side 250 to allow the cold antifreeze 124 to begin to pass through the inner cavity of the fourth side 250 of the 300 pound evaporator 205 in a downward direction flowing into a fourth small opening 265 along the bottom of the 300 lb evaporator 205 to the second half of the inner cavity of the second side 246. As the cold antifreeze 124 reaches the second half of inner cavity of the second side 246, and as the inner cavity of the second side 246 begins to fill to capacity the cold antifreeze will begin to pass through a fifth small opening 266 connecting the inner cavity of the second side 246, the inner cavity of the fourth side 250 and an inner cavity of a fifth side 252 to allow the cold antifreeze 124 to begin to pass through the inner cavity of the fifth side 252 of the 300 pound evaporator 205 in a upward direction. As the inner cavity of the fifth side 252 begins to fill up with cold antifreeze 124 then it will discharge the cold antifreeze 124 through an exit line 209.

FIG. 11 is an illustrative embodiment of a 10 pound device integrated with a refrigeration system. In one embodiment, the first inlet 106 controls the inflow of anti-freeze coming into the 10 lb evaporator body 105 from either a warm anti-freeze reservoir 118 or a cold anti-freeze reservoir 107. The process of freezing liquid within the device is initiated when the 10 lb evaporator body 105 is in upright position, wherein water or other liquid is provided from a water inlet 102 may be dispensed into the plurality of liquid reservoirs or containers 101 contained within the 10 lb evaporator body 105. The 10 lb evaporator body 105 initially receives cold antifreeze 124, through a first inlet 106 configured at the bottom of the device, which is pumped from a cold antifreeze reservoir 107. The cold antifreeze 124 begins to fill the inner cavity 108 (or heat transfer compartments) of the 10 lb evaporator body 105 wherein it reaches a pre-capacity level 126, prior to filling to capacity, then it's discharged to a side cavity 127, through a re-circulate outlet line 109 and re-circulated back into the first inlet 106 along with cold antifreeze 124 introduced from a cold antifreeze reservoir 107. Then, the cold antifreeze 124 begins to fill the inner cavity of the device 108 wherein it reaches a capacity level 129 (not shown), wherein the cold antifreeze 124 is filled to a capacity, then it's discharged through two outlet means (to be explained further). First, the cold antifreeze 124 will discharge to a side cavity 127, through a re-circulate outlet line 109 and re-circulate back into the first inlet 106 along with cold antifreeze 124 introduced from a cold antifreeze reservoir 107. Second, cold antifreeze 124 will discharge through a discharge outlet opening 110, which may be referred to as overflow discharge, wherein the cold anti-freeze 124 will be directed by the dump valve 111 to the cold antifreeze reservoir 107 for cooling.

There will be a thermostat 112 within the cold antifreeze reservoir 107 which measures the temperature of the cold anti-freeze 124 within the cold antifreeze reservoir 107 and when it reaches a certain temperature value t, then it causes the refrigeration system 113 to shut off, and causes a delay timer 114 to set an expiration time of n value, which will be turned off if the refrigeration system 113 is turned back on prior to expiration of expiration time value set to n. As time goes on, the thermostat 112 within the cold antifreeze reservoir 107 will measure a higher temperature than the temperature value t, and as a result the refrigeration system 113 will be turned on and the expiration time value of n will be turned off. The refrigeration system 113 will continue to provide, by means of a pump 119, cold antifreeze 124 from the cold antifreeze reservoir 107 into the 10 lb evaporator body 105 through the first inlet 106 to be circulated through the inner cavity 108 of the. The cold antifreeze 124 inside the cavity 108 of the 10 lb evaporator body 105 will continue to discharge from both the re-circulate outlet line 109 and the discharge outlet opening 110 as described above. The cycle described above will continue until the cold antifreeze reservoir 107 temperature reaches a certain temperature value t, and is able to maintain this temperature value t to exceed the expiration time of n.

When the delay timer expiration time of n has been exceeded, then it's determined that the liquid within the liquid reservoirs 101 is frozen and ready for harvesting. The system may set a cold anti-freeze upright drain delay timer 115 value of d1 to allow cold anti-freeze 124 to drain from the 10 lb evaporator body 105 into the cold anti-freeze reservoir 107. Upon expiration of the drain delay expiration timer 115 value of d1, the lever 116 will begin to turn the 10 lb evaporator body 105 180 degrees or completely upside down. Then the 10 lb evaporator body 105 may continue to allow cold antifreeze 124 to drain from the 10 lb evaporator body 105 through the discharge outlet opening 110 (a.k.a. overflow discharge valve) for a pre-determined amount of time d2 set on cold anti-freeze upside down drain delay timer 117. Then after expiration of the d1 and d2, then the dump valve will receive request to be re-directed to direct anti-freeze to the warm anti-freeze reservoir 118 and the entrance valve 154 will receive a request to be re-direct to permit warm anti-freeze to enter. At this point, the 10 lb evaporator body 105 is expected to have discharged any cold antifreeze 124 from its heat transfer compartments or cavity 108 and is ready to receive warm antifreeze 125 to release the ice within the liquid reservoirs 101. At this point, a second reservoir containing warm anti-freeze, also referred to as the warm antifreeze reservoir 118, will pump warm antifreeze 125 into the evaporator body 105, which is now upside down, through an entrance valve 154 to a first inlet 106 and allow the warm antifreeze to circulate within the heat transfer compartments or cavity 108 of the evaporator body 105.

The warm anti-freeze 125 will discharged through the discharge outlet opening 110 (overflow discharge valve) which will now be at the bottom side of the 10 lb evaporator body 105. Then, the dump valve 111 will direct the warm anti-freeze 125 discharged from the 10 lb evaporator body 105 to return to the warm anti-freeze reservoir 118. The warm anti-freeze reservoir 118 will have a float switch 120, which measures the water level in the warm antifreeze reservoir 118, and when it reaches a certain level, then the entrance valve 154 discontinues the entrance of warm anti-freeze 125 into the 10 lb evaporator body 105 because the central controller 122 knows that the device is now full of warm anti-freeze 125 sufficient to allow harvest to take place. The ice contained within the 10 lb evaporator body 105 will begin to release and eventually all ice will be released. The warm-anti-freeze 125 will continue to discharge through the discharge outlet opening 110 and the dump valve 111 will direct the warm anti-freeze 125 to return to the warm anti-freeze reservoir 118. After a pre-determined time period set to the warm anti-freeze upside down drain delay timer 121 to allow all the warm-antifreeze 125 to drain d3, then the lever 116 will return the device to its normal upright position and the dump valve 111 will be switched to direct antifreeze towards the cold anti-freeze reservoir 107. The water inlet 102 will begin to provide water 103 to be dispensed into the plurality of liquid reservoirs 101 contained within the 10 lb evaporator body 105.

Figure 12:
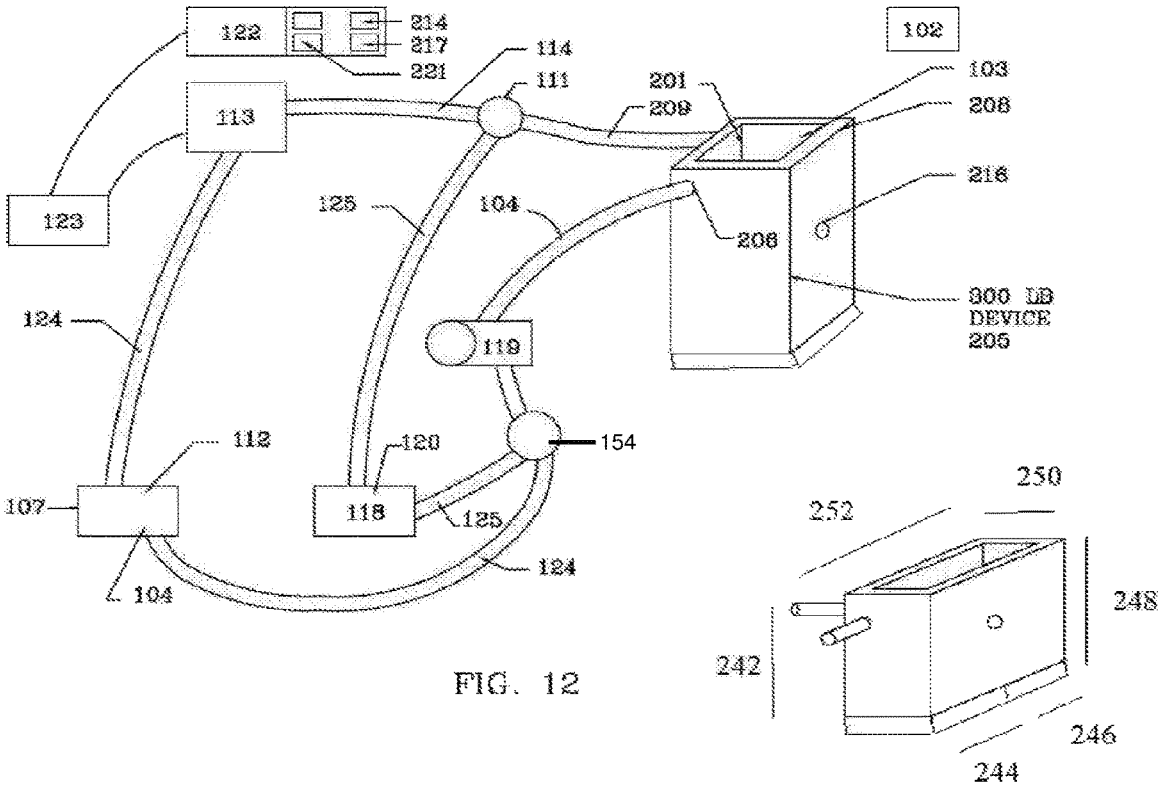
FIG. 12 illustrates a refrigeration system for the 300 lbs. block evaporator.

FIG. 12 is an illustrative embodiment of a three hundred (300) pound device integrated with a refrigeration system. In one embodiment, a 300 pound evaporator 205 is in upright position, wherein water may be dispensed into a single reservoir 201 contained within the 300 pound evaporator 205. The 300 pound evaporator 205 receives cold antifreeze 124, through a first inlet 206 configured at the top of a first side 242 of the 300 pound evaporator 205, which is pumped from a cold antifreeze reservoir 107.

The cold antifreeze 124 begins to pass through the inner cavity of the first side 242 of the 300 pound evaporator 205 in a downward direction. As the cold antifreeze 124 reaches the bottom of inner cavity of the first side 242 it will begin to pass through a first small opening 262 connecting the bottom portion of the inner cavity of the first side 242, the first half of inner cavity of the second side 244, and a inner cavity of the third side 248 to allow the cold antifreeze to begin to pass through the inner cavity of the third side 248 of the 300 pound evaporator 205 in a upward direction through a second small opening 263. As the cold antifreeze 124 reaches the top portion of the inner cavity of third side 248 it will begin to pass through a third small opening 264 connecting the top of the inner cavity of the third side 248 and the top of a inner cavity of the fourth side 250 to allow the cold antifreeze 124 to begin to pass through the inner cavity of the fourth side 250 of the 300 pound evaporator 205 in a downward direction flowing into a fourth small opening 265 along the bottom of the 300 lb evaporator 205 to the second half of the inner cavity of the second side 246. As the cold antifreeze 124 reaches the second half of inner cavity of the second side 246, and as the inner cavity of the second side 246 begins to fill to capacity the cold antifreeze will begin to pass through a fifth small opening 266 connecting the inner cavity of the second side 246, the inner cavity of the fourth side 250 and an inner cavity of a fifth side 252 to allow the cold antifreeze 124 to begin to pass through the inner cavity of the fifth side 252 of the 300 pound evaporator 205 in a upward direction. As the inner cavity of the fifth side 252 begins to fill up with cold antifreeze 124 then it will discharge the cold antifreeze 124 through an exit line 209 wherein the dump valve 111 is switched to allow the cold antifreeze to return to a cold antifreeze reservoir 107.

There will be a thermostat 112 within the cold antifreeze reservoir 107 which measures the temperature of the anti-freeze 104 and when it reaches a certain temperature value t, then it causes the refrigeration system 113 to shut off, and causes a upright cold anti-freeze delay timer 214 to set an expiration time of n value, which will be turned off if the refrigeration system 113 is turned back on prior to expiration of expiration time value set. As time goes on, the thermostat 112 within the cold antifreeze reservoir 107 will measure a higher temperature than the temperature value t, and as a result the refrigeration system 113 will be turned on and the expiration time value of n will be turned off. The refrigeration system 113 will continue to provide, by means of a pump 119, cold antifreeze 124 from the cold antifreeze reservoir 107 into the 300 pound evaporator 205 through the first inlet 206 to be circulated through all five sides of the 300 pound evaporator 205. The antifreeze within the inner cavities of the 300 pound device 206 will continue to discharge from the exit line 209 as described above. The cycle described above will continue until the cold antifreeze reservoir 107 thermostat 112 detects a temperature to reaches a certain temperature value t, and is able to maintain this temperature value t to a exceed the expiration time of n.

Upon expiration of timer of n, the lever 216 begins to turn the 300 pound evaporator 205 180 degrees (completely upside down). As a result of reaching temperature value t for an expiration time of n, the microcontroller 122 will send a signal to the refrigeration system 113 to turn it off. Then the 300 pound evaporator 205 will begin to drain the cold antifreeze 124 from the exit line 209, the first inlet 206, or both. After a pre-determined amount of time after lever 216 turned the device over as measured by an upside down delay drain timer 217, then it will be assumed that the cold antifreeze 124 has completely exited the inner cavities of the 300 pound evaporator 205 and been directed towards the cold antifreeze reservoir 107. At this point, the dump valve 111 is switched to allow any antifreeze 104 discharged from the 300 pound evaporator 205 to be directed towards a warm antifreeze reservoir 118. Then warm anti-freeze 125 from the warm antifreeze reservoir 118 will be introduced through the first inlet 206, by means of a pump 119, to the inner cavities 208 of the 300 pound evaporator 205. Then warm antifreeze reservoir 118 will provide warm antifreeze 125 into the 300 pound device 206, now upside down, through a first inlet 206 and allow the warm antifreeze 125 to circulate within the inner cavities of the 300 pound evaporator 205. The inner cavities of the 300 pound devices includes: the inner cavity of the first side 242, the first half of inner cavity of the second side 244, the second half of the inner cavity of the second side 246, the inner cavity of the third side 248, the inner cavity of the fourth side 250, and the inner cavity of the fifth side 252. The warm antifreeze 125 will travel in an upward direction through the inner cavity of the first side 242, reach the first half of the inner cavity of the second side 244, then be directed through the inner cavity of the third side 246, then the inner cavity of the fourth side 250, then the second half of the inner cavity of the second side 246, then the inner cavity of the fifth 252 until it's discharged through the exit line 209, to the dump valve 111, to be returned to the warm antifreeze reservoir 118. The warm anti-freeze reservoir 118 will have a float switch 120 which measures the water level in the warm antifreeze reservoir 118 and which it reaches a certain level, then it automatically stops providing warm antifreeze 125 because it knows that the 300 evaporator 205 is now full of warm anti-freeze 125 sufficient to allow harvest to take place. The ice contained within the single reservoir 201 of the 300 pound evaporator 205 will begin to release and eventually all ice will be released. The warm-anti-freeze 125 will continue to discharge through the exit line 209 and the dump valve will allow the warm anti-freeze 125 to return to the warm anti-freeze reservoir 118.

After a pre-determined time period measured by the warm antifreeze upside down drain timer 221 to allow all the warm-antifreeze 125 to drain, then the lever 116 will return the 300 pound evaporator 205 to its normal upright position and the dump valve control 111 will be switched to the direct antifreeze 104 towards the cold anti-freeze reservoir 107. The water inlet 102 will begin to provide water or other liquid to be dispensed into the reservoir 201 contained within the 300 pound evaporator 205.

It's known in the art to be able to substitute refrigerant in place of anti-freeze inside an evaporator in order to freeze liquid contents into solid state.

What is claimed is:

1. A ten-pound ice block apparatus, comprising:

a plurality of reservoirs configured to receive liquid for freezing;

a top cavity encasing exteriors of the plurality of reservoirs, having a hollow inner cavity encompassing a volume of space between the exteriors of the plurality of reservoirs and an interior of the top cavity;

a hollow bottom cavity having a solid top wall used to receive antifreeze from an inlet fixed to an exterior of a lower wall of the hollow bottom cavity and provide antifreeze to the top cavity through only a single opening set within the solid top wall of the hollow bottom cavity;

a hollow side cavity used to receive overflow antifreeze exiting from the hollow inner cavity through an overflow outlet set within a side wall of the hollow inner cavity;

a re-circulate outlet fixed to an exterior of a lower wall of the hollow side cavity configured to allow antifreeze to exit the hollow side cavity and re-circulate back into the hollow bottom cavity;

a discharge outlet fixed to an exterior of a side wall of the hollow side cavity configured to allow antifreeze to exit the hollow side cavity and returned to an antifreeze reservoir.

2. The apparatus of claim 1, further comprising a lever configured along two opposite ends of the ten-pound ice block apparatus to allow an external apparatus to rotate the ten-pound ice block apparatus upside down and right side up.

3. The apparatus of claim 1, wherein the single opening allows antifreeze to travel from the hollow bottom cavity to a plurality of vertical heat transfer compartments configured within the hollow inner cavity of the top cavity.

4. The apparatus of claim 3, wherein the vertical heat compartments occupy a volume of space between the exteriors of the plurality of reservoirs and the interior of the top cavity along a plurality of the perimeter side portions of the top cavity.

5. The apparatus of claim 1, wherein the single opening is set on an opposite side of the hollow side cavity.

6. The apparatus of claim 1, wherein the overflow outlet is set along a top portion of the side wall of the hollow inner cavity.

7. The apparatus of claim 1, wherein the discharge outlet is set along a top portion of the side wall of the hollow side cavity.

8. A ten-pound ice block apparatus, comprising:

a hollow bottom cavity having a solid top side configured to receive antifreeze from an inlet fixed to an exterior of a lower side of the hollow bottom cavity and provide antifreeze to a hollow top cavity through only a single opening set within the solid top side of the hollow bottom cavity;

the hollow top cavity having a plurality of vertical heat transfer compartments along exteriors of a plurality of reservoirs distributed within the hollow top cavity;

a hollow side cavity used to receive overflow antifreeze exiting from the hollow top cavity through an overflow outlet set within a shared side wall separating the hollow side cavity from the hollow top cavity;

a re-circulate outlet fixed to an exterior of a lower wall of the hollow side cavity to allow antifreeze to exit the hollow side cavity and re-circulate back into the hollow bottom cavity;

a discharge outlet fixed to an exterior of a side wall of the hollow side cavity to allow antifreeze to exit the hollow side cavity and returned to an antifreeze reservoir;

a lever configured along two opposite ends of the ten-pound ice block apparatus to allow an external apparatus to rotate the ten-pound ice block apparatus upside down and right side up.

9. The apparatus of claim 8, wherein the hollow bottom cavity is a rectangular cavity having six solid sides with the single opening set within the solid top side of the hollow bottom cavity.

10. The apparatus of claim 8, wherein the overflow outlet is set along a top portion of the shared side wall separating the hollow side cavity from the hollow top cavity.

11. The apparatus of claim 8, wherein the discharge outlet is set along a top portion of the side walls of the hollow side cavity.

12. The apparatus of claim 8, wherein the lever is controlled by an external gear and motor system.

13. The apparatus of claim 8, wherein the single opening is set on an opposite side of the hollow side cavity.

14. A ten-pound ice block apparatus, comprising:

a hollow bottom cavity having a solid top side configured to receive antifreeze from an inlet fixed to a lower side of the hollow bottom cavity and provide antifreeze to a hollow top cavity through at least one opening set within the solid top side of the hollow bottom cavity;

the hollow top cavity having a plurality of vertical heat transfer compartments along exteriors of a plurality of reservoirs distributed within the hollow top cavity;

a hollow side cavity used to receive overflow antifreeze exiting from the hollow top cavity through an overflow outlet set within a shared side wall separating the hollow side cavity from the hollow top cavity;

a re-circulate outlet fixed to a lower wall of the hollow side cavity to allow antifreeze to exit the hollow side cavity and re-circulate back into the hollow bottom cavity;

a discharge outlet fixed to a side wall of the hollow side cavity to allow antifreeze to exit the side cavity and returned to an antifreeze reservoir.

15. The apparatus of claim 14, wherein the hollow bottom cavity is a rectangular cavity having six solid sides with the at least one opening set within the solid top side of the hollow bottom cavity.

16. The apparatus of claim 14, wherein the recirculate outlet is connected to an external pump.

17. The apparatus of claim 14, wherein the discharge outlet is set along a top portion of the side wall of the hollow side cavity.

18. The apparatus of claim 14, further comprising a lever, wherein the lever is controlled by an external gear and motor system.

19. The apparatus of claim 14, wherein the at least one opening is set on an opposite side of the hollow side cavity.

20. The apparatus of claim 14, wherein the overflow outlet is set along a top portion of the shared side wall separating the hollow side cavity from the hollow top cavity.

* * * * *